United States Patent [19]

Taumann et al.

[11] 4,121,109

[45] Oct. 17, 1978

[54] ELECTRON ACCELERATOR WITH A TARGET EXPOSED TO THE ELECTRON BEAM

[75] Inventors: Leonhard Taumann, Lafayette, Calif.; Rudolf Schittenhelm, Erlangen, Germany

[73] Assignee: Applied Radiation Corporation, Walnut Creek, Calif.

[21] Appl. No.: 787,275

[22] Filed: Apr. 13, 1977

[51] Int. Cl.[2] ..... H05G 3/00

[52] U.S. Cl. ..... 250/505; 250/510

[58] Field of Search ..... 250/505, 510, 398, 399

[56] References Cited

U.S. PATENT DOCUMENTS

| | | | |
|---|---|---|---|
| 3,227,880 | 1/1966 | Wederoe | 250/505 |
| 3,767,931 | 10/1973 | Williams | 250/505 |
| 3,882,314 | 5/1975 | Benedetti | 250/505 |
| 3,917,954 | 11/1975 | Boge | 250/505 |

*Primary Examiner*—Craig E. Church

*Attorney, Agent, or Firm*—Hill, Gross, Simpson, Van Santen, Steadman, Chiara & Simpson

[57] ABSTRACT

In an electron accelerator having a target which is subjected to an electron beam for the production of deceleration radiation, a collimator is provided behind the target which has a passageway adapted to receive a beam cone of maximum dimensions. Adjustable x-ray aperture plates are provided behind the collimator and an electron absorber is provided behind the target. An additional electron absorber is positioned in a widened portion at one end of the passageway in the collimator. Both electron absorbers are made of a material having a relatively low atomic number as compared with electron absorbers of the prior art.

10 Claims, 3 Drawing Figures

ELECTRON ACCELERATOR WITH A TARGET EXPOSED TO THE ELECTRON BEAM

BACKGROUND OF THE INVENTION

1. Field of the Invention

The invention relates to an electron accelerator with a target exposed to the electron beam for the production of x-ray deceleration radiation. A collimator is arranged behind the target in the beam direction having a passageway of fixed dimensions sufficient for maximum adjustable beam cone dimensions. Adjustable x-ray aperture plates are positioned behind the collimator and an electron absorber is positioned behind the target in the beam direction.

2. Description of the Prior Art

For the production of x-rays, a target, which may comprise a plate of several mm thickness and made of heavy metal, preferably tungsten, is placed into the electron beam of the electron accelerator. The thickness of the target represents a compromise. If the target is selected too thin, insufficient x-ray quanta will be produced. If the target is selected too thick, an undesirable number of x-rays will be absorbed in the target itself. Furthermore, the maximum of the energy spectrum is then shifted towards the long-wave range. In order to prevent electrons from passing through the target having a prior art thickness into the x-ray cone, it is known in the art to place so-called electron absorbers directly behind the target into a boring of a target sled which also retains the target. For example, an absorption member made of copper or another metal of a medium atomic number may be inserted in order to receive superfluous electron radiation but which only slightly weakens the x-rays produced in the target. There is the disadvantage, however, that additional x-ray quanta are produced by electrons in the material of the electron absorber. These x-ray quanta have another origin than the radiation quanta produced in the target and are of a lower energy. Consequently, they are medically undesired and increase a half-shadow region at the margin of the x-ray cone or width of the radiation.

SUMMARY OF THE INVENTION

It is the object of the invention to avoid the production of x-ray quanta in the electron absorber without impairing its ability to absorb the superfluous electrons.

In the case of an electron accelerator of this invention, the electron absorber is produced of a material of a low atomic number. The efficiency cross section for the production of x-ray decleration radiation increases very strongly with the atomic number. The specific electron absorption is proportional to the density. For this the superfluous electrons can be absorbed and the additional x-ray quanta can be greatly reduced by reducing the atomic number. Due to the decreased specific electron absorption which simultaneously results, the thickness of the electron absorber must be correspondingly increased in the beam direction.

More favorable geometric dimensions of the beam defining system can be obtained when, in a further deveopment of the invention, an additional electron absorber having outer dimensions corresponding to the inner dimensions of the passageway of the collimator is placed into the collimator. With such an additional absorber, there is no need to increase the height of the target sled even though the atomic number of the electron absorber material is decreased and the thickness of the electron absorber is increased.

DESCRIPTION OF THE PREFERRED EMBODIMENTS

Figure 1:
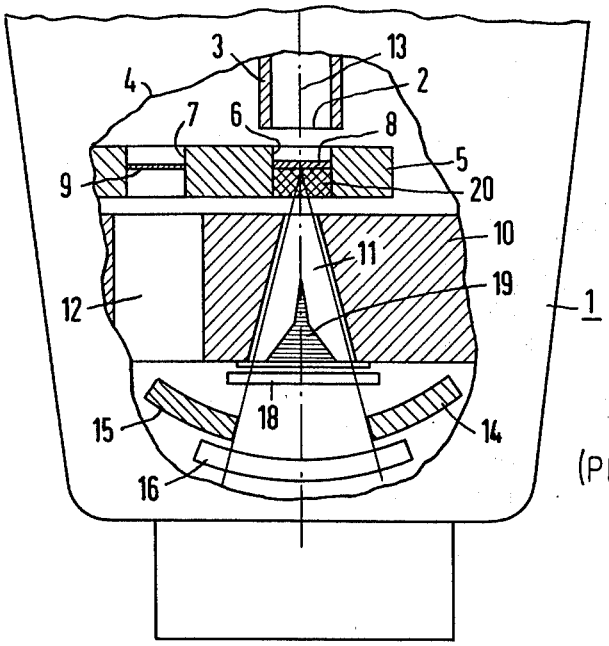
Fig. 1 (PRIOR ART)
FIG. 1 is a partial cross sectional view of the beam defining system of an electron accelerator with a prior art arrangement of an electron absorber.

FIG. 1 illustrates the construction of a prior art beam defining system 1 of an electron accelerator in a simplified representation. A target sled or carriage 5 can be recognized in the sectioned portion 4 of the beam defining system 1, directly behind the exit window 2 of an evacuated beam guiding container 3. Several borings 6, 7 are placed into the target sled. The target 8 comprised of a heavy metal plate is positioned in one of these borings 6, 7 for the production of x-ray deceleration radiation. A scattering foil 9 for scattering the electrons when the electron accelerator is used as an electron beam source is positioned in the other boring 7 of the target sled 5. A collimator 10 is positioned behind the target sled 5 in the beam direction. It has a passageway 11 for the x-ray deceleration radiation produced by the target 8, as well as a further passageway 12 for electrons scattered in a scattering foil 7 in the case of a correspondingly adjusted target sled 5. In this case, the collimator 10 must be shifted in such a way that this other passageway 12 is centered with respect to the electron beam 13. The passageway 11 for the x-rays has a conical shape. An ionization chamber 18 for controlling the radiation leaving the accelerator is provided between the adjustable x-ray aperture plates 14, 15, 16 and the collimator 10. A compensating member 19 for the x-rays is positioned within the passageway 11 of the collimator 10. An electron absorber 20 made of copper is provided in the target sled 5 in the boring 6 directly behind the target 8. This electron absorber 20 absorbs electrons behind the target. However, x-ray deceleration radiation is also produced in the material of the electron absorber. Due to the location of this radiation, which deviates from the radiation produced by the target 8, such electron absorber produced radiation cannot be limited by the adjustable x-ray aperture plates 14, 15, 16 to exactly the same field as the x-ray quanta produced by the target itself. The x-ray quanta produced in the electron absorber 20 thus contribute to the formation of half-shadow regions at the margins of the irradiated field.

Figure 2:
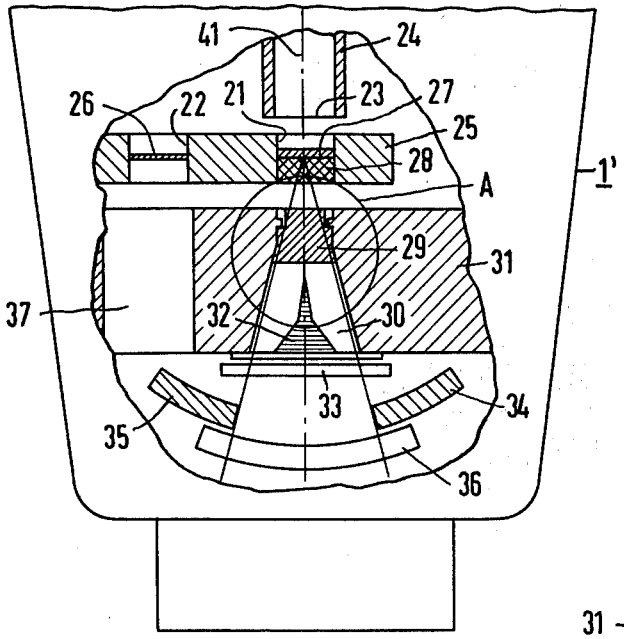
FIG. 2 is a partial cross sectional view of the beam defining system of an electron accelerator with electron absorption in accordance with this invention.

In the case of the beam defining system 1' of this invention shown in FIG. 2, a scattering foil 26 and a target 27 are positioned in the borings 21, 22 of the target sled 25. The sled 25 is arranged directly behind the exit window 23 of the beam-guide container 24 in the beam direction in the same manner as in the beam defining system of FIG. 1. An electron absorber 28 provided in the target sled 25 directly behind the target 27, however, does not consist of copper but of a material of low atomic number. In one preferred embodiment the absorber 28 consists of graphite. Since the absorption coefficient of such an absorber is less than an electron absorber made of copper, an additional electron absorber 29 is positioned into the passageway of a collimator 31 positioned behind the target sled 25 in the beam direction. This electron absorber also consists of a material of low atomic number. In the preferred embodiment, aluminum is used due to the ease of processing. The portion of the passageway 30 of the collimator 31 which is not filled by the compensating member 32 is available for the absorber 29. This portion is suitable for obtaining sufficiently long absorption paths in order to decrease the atomic number down to about 6. The arrangement of the remaining components such as the ionization chamber 33; the adjustable x-ray aperture plates 34, 35, 36; and the further passageway 37 for electron radiation in the collimator 31 remains unchanged.

Figure 3:
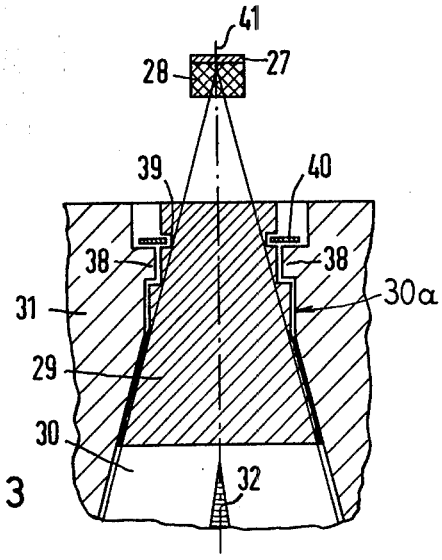
FIG. 3 is an enlarged representation of the electron absorbing portion of the electron accelerator of FIG. 2.

FIG. 3 shows an enlarged illustration of the attachment of the additional electron absorber 29 in the passageway 30 of the collimator. The passageway of the collimator, which tapers down conically towards the target 27, is cylindrically expanded at its most narrow portion 30*a* and is provided with a circumferentially protruding margin 38. The additional electron absorber 29 which is to be inserted has outer dimensions corresponding to the inner dimensions of the passageway 30 of the collimator 31 in such a way that it can be positioned within the latter and will fully rest against the inner wall of the collimator 31 as close as possible to the protruding margin 38 in the cylindrical narrow portion 30*a*. In a portion turned towards the target 27, the additional electron absorber 29 is provided with a circumferential ring groove 39 into which a spring or snap ring 40 can be inserted. The ring 40 is supported upon the protruding margin 38 of the collimator 31 and which thus supports or anchors the additional electron absorber 29 in the collimator 31.

During operation of the electron accelerator for the production of x-ray deceleration radiation by use of the target 27 in the electron beam 41, electrons are no longer completely absorbed in the electron absorber 28 arranged in the target sled 25 behind the target 27. This results from the low atomic number of the material used for the electron absorber without a considerable increase in its thickness. To solve the problems of using an electron absorber of low atomic numbers, another electron absorber 29 is inserted in the passageway 30 of the collimator 31 ahead of the compensating member 32. This results in a path sufficient for the full absorption of the electrons in the material of the two electron absorbers arranged one behind the other, without requiring an increase of the atomic number of the electron absorbing material above the value of aluminum. As compared with the prior art, by reducing the atomic number additional x-rays are no longer produced in the material of the electron absorbers 28, 29. Thus, the beam definition which can respectively be obtained with the adjustable x-rays aperture plates 34, 35, 36 becomes sharper and the maximum of the energy spectrum of the x-rays is somewhat shifted into the short-wave range.

Since a portion of the electron absorbing material is placed into the collimator, the collimator will participate in the heat dissipation from the electron absorber. The target sled is thus relieved. Surprisingly, the dose distortion in the edges of the maximum adjustable beam field is clearly decreased due to the insertion of the second electron absorber in the passageway of the collimator.

Although various minor modifications may be suggested by those versed in the art, it should be understood that it is intended to embody within the scope of the patent warranted hereon, all such embodiments as reasonably and properly come within the scope of this contribution to the art.

Claimed as the invention:

1. An electron accelerator comprising:

(a) an electron beam;

(b) a target means exposed to the electron beam for the production of x-ray deceleration radiation in a beam cone;

(c) a collimator behind the target in the direction of the beam, said collimator having a fixed dimension passageway sufficient for a beam cone adjusted to maximum dimensions;

(d) adjustable x-ray aperture plates behind the collimator in the direction of the beam; and (e) an electron absorber behind the target in the direction of the beam, said absorber being made of a material of a relatively low atomic number which is lower than the atomic number of copper, and an additional electron absorber positioned in the collimator and made of a material atomic number lower than the atomic number of copper.

2. An electron accelerator comprising:

(a) an electron beam;

(b) a target means exposed to the electron beam for the production of x-ray deceleration radiation in a beam cone;

(c) a collimator behind the target in the direction of the beam, said collimator having a fixed dimension passageway sufficient for a beam cone adjusted to maximum dimensions;

(d) adjustable x-ray aperture plates behind the collimator in the direction of the beam;

(e) an electron absorber behind the target in the direction of the beam, said absorber being made of a material of a relatively low atomic number which is lower than the atomic number of copper; and (f) an additional electron absorber positioned in the collimator and having outer dimensions corresponding to inner dimensions of said passageway of the collimator.

3. An electron accelerator in accordance with claim 2 in which the passageway of the collimator is essentially conical, and has a widened end portion facing the target, said widened end portion having an inwardly protruding margin not touching the beam cone of maximum dimensions, said protruding margin supporting the additional electron absorber.

4. An electron accelerator in accordance with claim 3, characterized in that the additional electron absorber carries a springlike ring engaging with the protruding margin in the widened end portion of the passageway of the collimator.

5. An electron accelerator in accordance with claim 1, characterized in that the electron absorber is made of aluminum.

6. An electron accelerator in accordance with claim 1, characterized in that the electron absorber is made of graphite.

7. An electron accelerator in accordance with claim 2 in which said additional electron absorber is made of aluminum.

8. An electron accelerator in accordance with claim 2 in which said additional electron absorber is made of graphite.

9. An electron accelerator comprising:

(a) an electron beam;

(b) a target means exposed to the electron beam for the production of x-ray radiation in the shape of a beam cone;

(c) mounting means for the target means;

(d) a collimator behind the target in the direction of the beam, said collimator having a conical passageway dimensioned to correspond with dimensions of said beam cone;

(e) x-ray aperture plates behind the collimator in the direction of the beam;

(f) an electron absorber on the mounting means directly behind the target means in the direction of the beam;

(g) an additional electron absorber adjacent one end of the passageway in the collimator; and (h) said one end of the conical passageway being widened and having means for mounting the additional electron absorber.

10. An electron accelerator according to claim 9 in which both of said electron absorbers are made of a material of a relatively low atomic number which is lower than the atomic number of copper.

* * * * *